US009924288B2

(12) United States Patent
Cagdaser et al.

(10) Patent No.: US 9,924,288 B2
(45) Date of Patent: Mar. 20, 2018

(54) BLOCKAGE DETECTION FOR A MICROELECTROMECHANICAL SYSTEMS SENSOR

(71) Applicant: INVENSENSE, INC., San Jose, CA (US)

(72) Inventors: Baris Cagdaser, Sunnyvale, CA (US); Renata Melamud Berger, Palo Alto, CA (US); Omid Oliaei, Sunnyvale, CA (US); Aleksey S. Khenkin, Nashua, NH (US)

(73) Assignee: INVENSENSE, INC., San Jose, CA (US)

( * ) Notice: Subject to any disclaimer, the term of this patent is extended or adjusted under 35 U.S.C. 154(b) by 132 days.

(21) Appl. No.: 14/527,235

(22) Filed: Oct. 29, 2014

(65) Prior Publication Data

US 2016/0127845 A1 May 5, 2016

(51) Int. Cl.

| | |
|---|---|
| ***H04R 29/00*** | (2006.01) |
| *H04R 3/00* | (2006.01) |
| *H04R 25/00* | (2006.01) |
| *H04R 3/04* | (2006.01) |

(52) U.S. Cl.

CPC ..... *H04R 29/004* (2013.01); *H04R 3/00* (2013.01); *H04R 3/04* (2013.01); *H04R 25/305* (2013.01); *H04R 2201/003* (2013.01); *H04R 2460/11* (2013.01); *H04R 2499/11* (2013.01)

(58) Field of Classification Search

CPC ..... H04R 25/305; H04R 3/04; H04R 3/00; H04R 25/70; H04R 29/004; H04R 2201/003; H04R 2499/11; H04R 2460/11; G06F 1/163

USPC ..... 381/56, 57, 58, 316, 314, 59; 367/162, 367/163, 174

See application file for complete search history.

(56) References Cited

U.S. PATENT DOCUMENTS

| | | | | |
|---|---|---|---|---|
| 6,504,795 | B1 * | 1/2003 | Niederer | G10K 11/168 367/162 |
| 9,264,803 | B1 * | 2/2016 | Johnson | H04R 3/00 |
| 2003/0119220 | A1 * | 6/2003 | Mlcak | B81B 3/0089 438/52 |
| 2010/0074451 | A1 * | 3/2010 | Usher | H04R 25/70 381/58 |
| 2010/0183174 | A1 | 7/2010 | Suvanto et al. | |

(Continued)

FOREIGN PATENT DOCUMENTS

| | | | |
|---|---|---|---|
| EP | 1276349 | A1 | 1/2003 |
| EP | 1648150 | A2 | 4/2006 |
| WO | 2009097407 | A1 | 8/2009 |

OTHER PUBLICATIONS

International Search Report and Written Opinion dated Jan. 11, 2016 for PCT Application Serial No. PCT/US2015/057909, 14 pages.

*Primary Examiner* — Vivian Chin
*Assistant Examiner* — Ubachukwu Odunukwe
(74) *Attorney, Agent, or Firm* — Amin, Turocy & Watson, LLP

(57) ABSTRACT

Systems and techniques for detecting blockage associated with a microelectromechanical systems (MEMS) microphone of a device are presented. The device includes a MEMS acoustic sensor and a processor. The MEMS acoustic sensor is contained in a cavity within the device. The processor is configured to detect a blockage condition associated with an opening of the cavity that contains the MEMS acoustic sensor.

23 Claims, 14 Drawing Sheets

(56) References Cited

U.S. PATENT DOCUMENTS

| | | | | |
|---|---|---|---|---|
| 2013/0044898 | A1* | 2/2013 | Schultz | H04R 3/06 381/111 |
| 2013/0099909 | A1* | 4/2013 | Merritt | B62J 3/00 340/432 |
| 2013/0329896 | A1 | 12/2013 | Krishnaswamy et al. | |
| 2015/0030169 | A1* | 1/2015 | Pan | H04R 29/001 381/59 |
| 2015/0304786 | A1* | 10/2015 | Partio | H04R 25/305 381/58 |
| 2016/0100256 | A1* | 4/2016 | Watson | H04R 19/04 381/113 |

* cited by examiner

BLOCKAGE DETECTION FOR A MICROELECTROMECHANICAL SYSTEMS SENSOR

TECHNICAL FIELD

The subject disclosure relates to microelectromechanical systems (MEMS) sensors.

BACKGROUND

Microphones are widely integrated in consumer electronic devices such as, for example, smartphones. A microphone of a consumer electronic device is typically implemented as a microelectromechanical systems (MEMS) microphone device that is mounted on a printed circuit board (PCB) of the consumer electronic device. A MEMS microphone device typically includes a hole that allows sound to reach a sensing portion of the MEMS microphone device. The PCB associated with the MEMS microphone device also typically has a hole that allows sound to reach the sensing portion of the MEMS microphone device. Therefore, the hole of the MEMS microphone device and the hole of the PCB can form an audio port (e.g., an audio path) for sound to reach the sensing portion of the MEMS microphone device.

Because of the demand to make consumer electronic devices smaller and/or design constraints that prevent large holes in consumer electronic devices, the audio port that allows sound to travel to the sensing portion of the MEMS microphone device inside a consumer electronic device is often small. Due to the small size of the audio port, the audio port is prone to blockage. Blockage of an audio port can be caused, for example, by a thumb or finger of a user, foreign material such as dirt, food or water, etc. Consequently, a MEMS microphone of a conventional consumer electronic device is prone to decreased quality and/or performance due to blockage of an audio port associated with the MEMS microphone.

It is thus desired to provide MEMS microphone systems that improve upon these and other deficiencies. The above-described deficiencies are merely intended to provide an overview of some of the problems of conventional implementations, and are not intended to be exhaustive. Other problems with conventional implementations and techniques, and corresponding benefits of the various aspects described herein, may become further apparent upon review of the following description.

SUMMARY

The following presents a simplified summary of the specification to provide a basic understanding of some aspects of the specification. This summary is not an extensive overview of the specification. It is intended to neither identify key or critical elements of the specification nor delineate any scope particular to any embodiments of the specification, or any scope of the claims. Its sole purpose is to present some concepts of the specification in a simplified form as a prelude to the more detailed description that is presented later.

In accordance with an implementation, a device includes a microelectromechanical systems (MEMS) acoustic sensor and a processor. The MEMS acoustic sensor is contained in a cavity within the device. The processor is configured to detect a blockage condition associated with an opening of the cavity that contains the MEMS acoustic sensor.

In accordance with another implementation, a method provides for receiving an acoustic signal via an opening of a cavity that encloses a MEMS acoustic sensor, and detecting a blockage condition associated with the MEMS acoustic sensor based on one or more characteristics of the MEMS acoustic sensor in response to the acoustic signal.

In accordance with yet another implementation, a system includes a first MEMS microphone, a second MEMS microphone and at least one processor. The first MEMS microphone is contained in a cavity within a device and configured to receive an acoustic signal. The second MEMS microphone is contained in another cavity within the device. The at least one processor is configured to detect a blockage condition associated with a least the first MEMS microphone.

These and other embodiments are described in more detail below.

BRIEF DESCRIPTION OF THE DRAWINGS

Various non-limiting embodiments are further described with reference to the accompanying drawings, in which.

DETAILED DESCRIPTION

Overview

Figure 1:
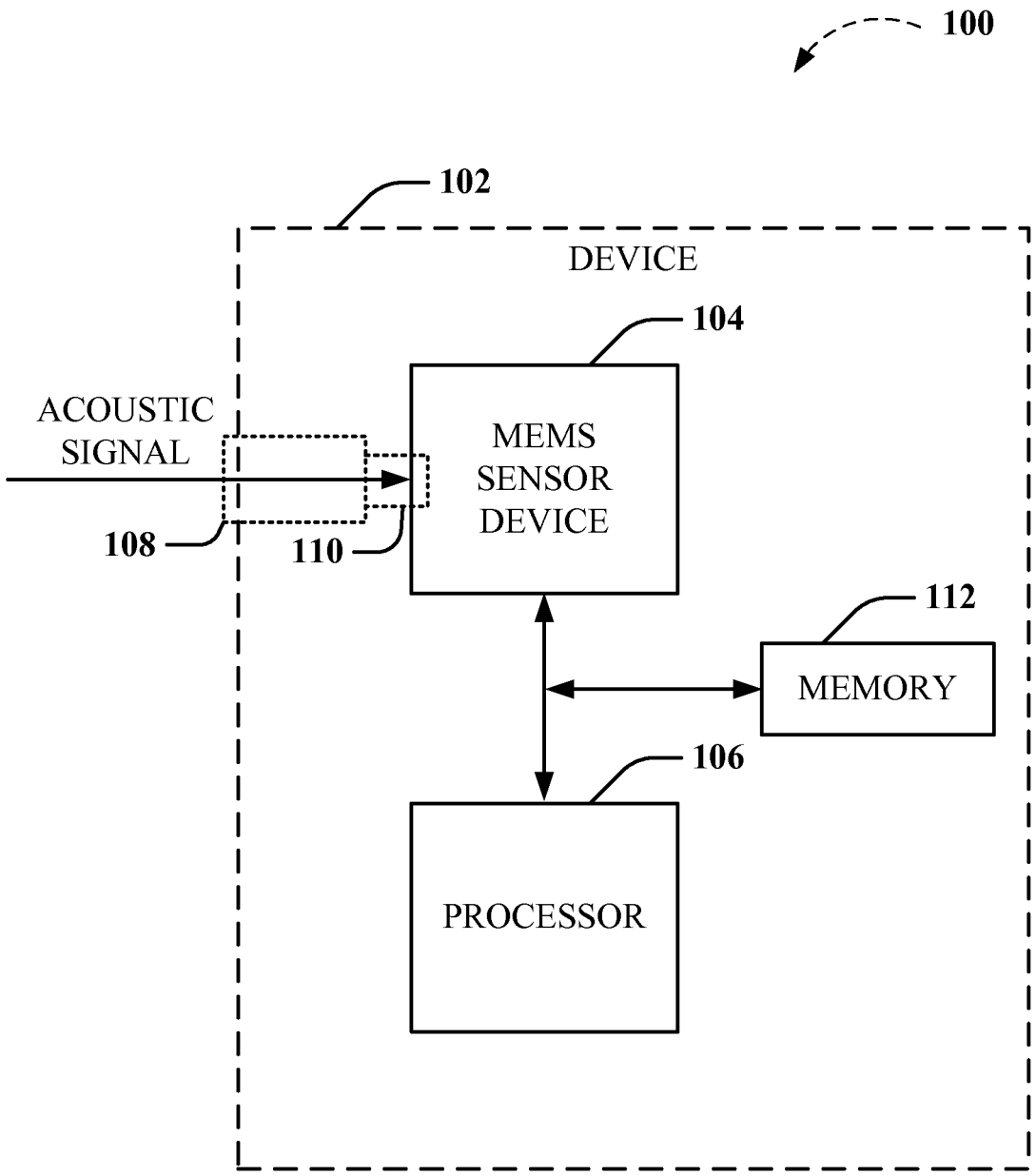
FIG. 1 depicts a functional block diagram of a system for detecting blockage associated with a microelectromechanical systems (MEMS) sensor, in accordance with various aspects and implementations described herein.

While a brief overview is provided, certain aspects of the subject disclosure are described or depicted herein for the purposes of illustration and not limitation. Thus, variations of the disclosed embodiments as suggested by the disclosed apparatuses, systems, and methodologies are intended to be encompassed within the scope of the subject matter disclosed herein.

As described above, microelectromechanical systems (MEMS) microphones of conventional consumer electronic devices (e.g., smartphones, etc.) are prone to blockage, which can result in decreased quality and/or performance of a consumer electronic device (e.g., a MEMS microphone of a consumer electronic device).

To these and/or related ends, various aspects of microphone blockage detection for a device (e.g., a consumer electronic device) are described. The various embodiments of the apparatuses, techniques, and methods of the subject disclosure are described in the context of MEMS sensors (e.g., MEMS microphones) of a device (e.g., a consumer electronic device). Exemplary embodiments of the subject disclosure provide microphone blockage detection (e.g., MEMS microphone blockage detection) to, for example, increase quality and/or performance of a device (e.g., a consumer electronic device, a MEMS microphone of a consumer electronic device, etc.).

According to an aspect, a blockage condition associated with a MEMS acoustic sensor (e.g., a MEMS acoustic microphone) can be detected. A blockage condition can relate to a blockage of an opening associated with a MEMS acoustic sensor and/or a device that includes the MEMS acoustic sensor. In one example, a blockage condition associated with a MEMS acoustic sensor (e.g., a MEMS acoustic microphone) can be detected based on frequency response (e.g., a change in frequency response) of a MEMS acoustic sensor in response to an acoustic signal received by the MEMS acoustic sensor. For example, a shift of a resonant peak associated with a frequency response of a MEMS acoustic sensor can indicate a blockage condition. Additionally or alternatively, a blockage condition associated with a MEMS acoustic sensor can be detected based on a test acoustic signal received by the MEMS acoustic sensor. The test acoustic signal can be generated by a device associated with the MEMS acoustic sensor (e.g., an acoustic signal generator of a device associated with the MEMS acoustic sensor). For example, another MEMS acoustic sensor can generate the test acoustic signal. In one example, the test acoustic signal can be an ultrasonic signal. As such, a blockage condition associated with a MEMS acoustic sensor can be detected based on frequency response (e.g., a change in frequency response) of a MEMS acoustic sensor in response to the test acoustic signal received by the MEMS acoustic sensor. Additionally or alternatively, a blockage condition associated with a MEMS acoustic sensor can be detected based on a proximity sensor associated with the MEMS acoustic sensor (e.g., a proximity sensor associated with an opening of a cavity that contains the MEMS acoustic sensor).

However, as further detailed below, various exemplary implementations can be applied to other areas of microphone blockage detection, without departing from the subject matter described herein.

Exemplary Embodiments

Various aspects or features of the subject disclosure are described with reference to the drawings, wherein like reference numerals are used to refer to like elements throughout. In this specification, numerous specific details are set forth in order to provide a thorough understanding of the subject disclosure. It should be understood, however, that the certain aspects of disclosure may be practiced without these specific details, or with other methods, components, parameters, etc. In other instances, well-known structures and devices are shown in block diagram form to facilitate description and illustration of the various embodiments.

FIG. 1 depicts a functional block diagram of a system 100 for detecting blockage associated with a microelectromechanical systems (MEMS) microphone, according to various non-limiting aspects of the subject disclosure. A MEMS microphone can include, but is not limited to, a capacitive MEMS microphone, a piezoelectric MEMS microphone, a pizeoresistive MEMS microphone, a condenser MEMS microphone, an electret MEMS microphone, an analog MEMS microphone, a digital MEMS microphone, another type of MEMS microphone, etc. System 100 includes a device 102. The device 102 can be, for example, a consumer electronic device. For example, the device 102 can be a phone, a smartphone, a smartwatch, a tablet, an eReader, a netbook, an automotive navigation device, a gaming console or device, a wearable computing device, another type of computing device, etc. The device 102 can include a MEMS sensor device 104 and a processor 106. The MEMS sensor device 104 can be mechanically, electrically, and/or communicatively coupled to the processor 106. In one example, the processor 106 can be implemented separate from the MEMS sensor device 104. In another example, the MEMS sensor device 104 can include the processor 106. In an aspect, the processor 106 can be associated with an application specific integrated circuit (ASIC) complementary metal oxide semiconductor (CMOS) chip that supports the MEMS sensor device 104.

Figure 5:
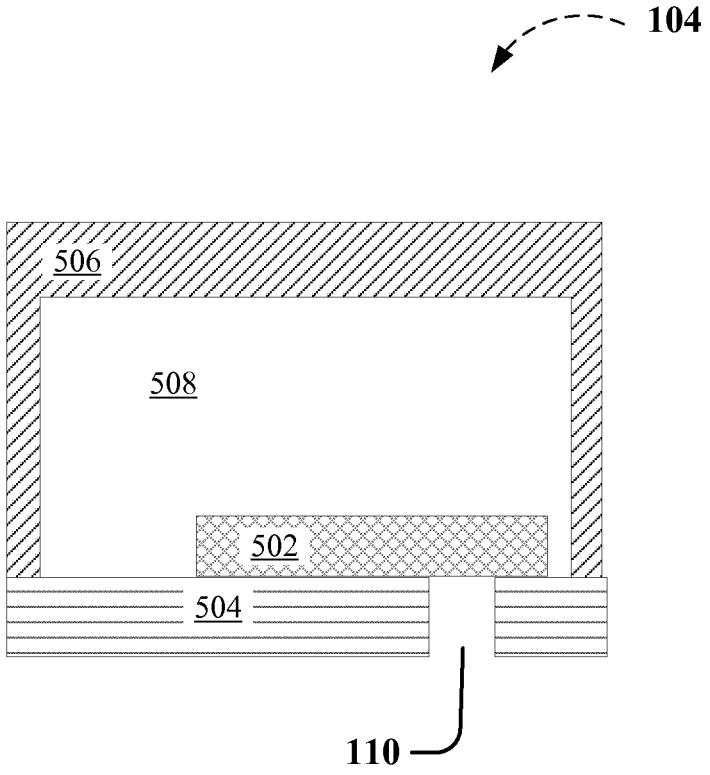
FIG. 5 depicts a non-limiting example of a MEMS sensor device, in accordance with various aspects and implementations described herein.
Figure 6:
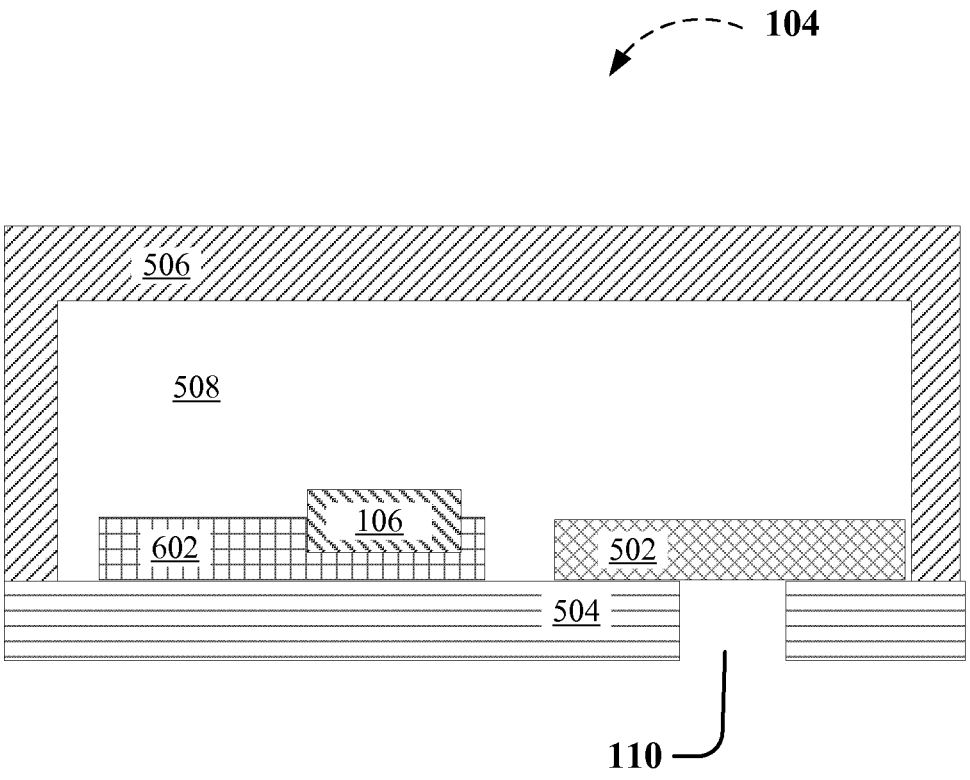
FIG. 6 depicts another non-limiting example of a MEMS sensor device, in accordance with various aspects and implementations described herein.
Figure 7:
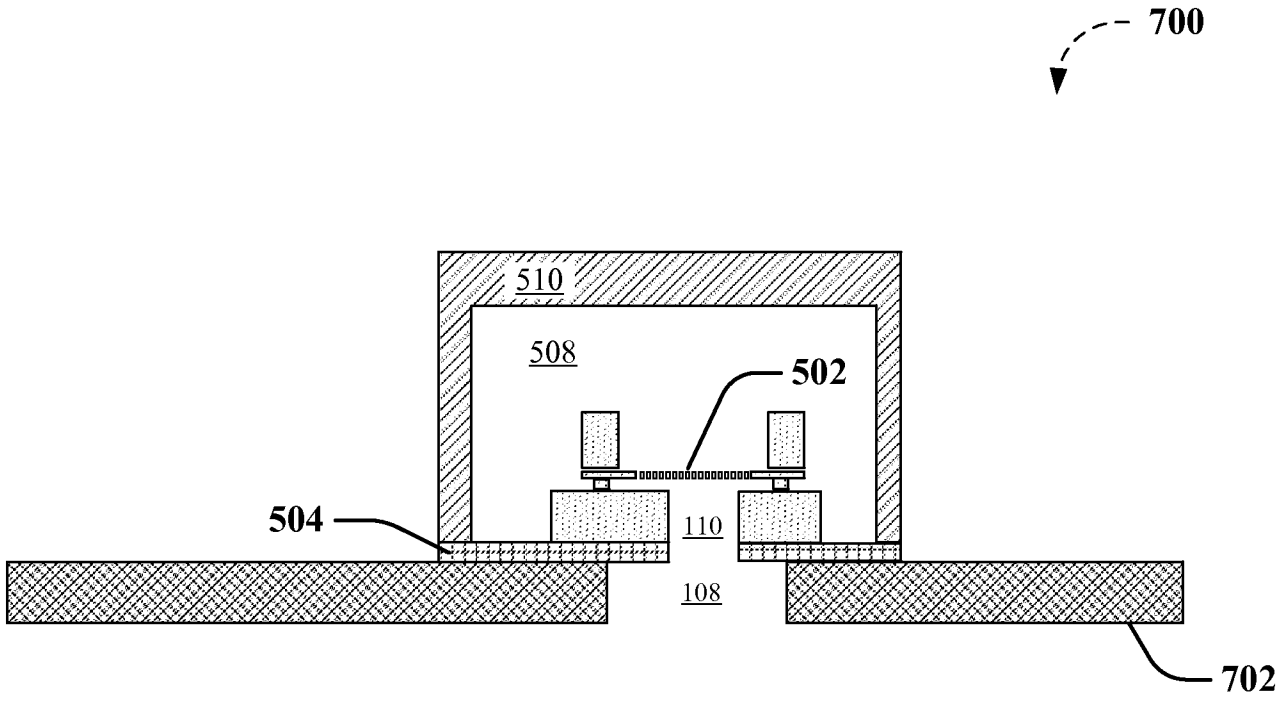
FIG. 7 depicts a non-limiting example of a MEMS sensor device implemented in a device, in accordance with various aspects and implementations described herein.

The device 102 (e.g., a case of the device 102) can include an opening 108 (e.g., a first opening 108) associated with the MEMS sensor device 104. Additionally, the MEMS sensor device 104 can include an opening 110 (e.g., a second opening 110). In one example, the opening 108 of the device 102 (e.g., the first opening 108) can be larger than the opening 110 of the MEMS sensor device 104 (e.g., the second opening 110). In another example, the opening 108 of the device 102 (e.g., the first opening 108) can be smaller than the opening 110 of the MEMS sensor device 104 (e.g., the second opening 110). In yet another example, the opening 108 of the device 102 (e.g., the first opening 108) can be the same size as (e.g., approximately the same size as) the opening 110 of the MEMS sensor device 104 (e.g., the second opening 110). The opening 108 of the device 102 (e.g., the first opening 108) can be an opening in a case of the device 102. The opening 110 of the MEMS sensor device 104 (e.g., the second opening 110) can be an opening of a cavity that encloses a MEMS acoustic sensor (as shown in FIGS. 5-7) of the MEMS sensor device 104. The MEMS acoustic sensor of the MEMS sensor device 104 can be, for example, a MEMS acoustic microphone.

The opening 108 and the opening 110 can be connected to form an audio port (e.g., an audio path, an audio channel, an audio passage, etc.) for sound to travel to reach the MEMS acoustic sensor of the MEMS sensor device 104. Under normal operating conditions, the device 102 can receive an acoustic signal (e.g., ACOUSTIC SIGNAL shown in FIG. 1) via the opening 108 associated with the MEMS sensor device 104 (e.g., the first opening 108). The MEMS sensor device 104 can further receive the acoustic signal via the opening 110 of the MEMS sensor device 104 (e.g., the second opening 110). For example, the MEMS acoustic sensor of the MEMS sensor device 104 can receive the acoustic signal via the opening 110 of the MEMS sensor device 104 (e.g., the second opening 110). Accordingly, the acoustic signal can reach the MEMS acoustic sensor via an audio port formed by the opening 108 and the opening 110. It is to be appreciated that in certain implementations the opening 108 and the opening 110 can be implemented as a single opening.

The processor 106 can be configured to detect a blockage condition (e.g., an unintentional blockage condition, an unwanted blockage condition, etc.) associated with the MEMS sensor device 104 (e.g., the MEMS acoustic sensor of the MEMS sensor device 104). For example, the processor 106 can be configured to detect a blockage condition associated with the opening 108 of the device 102 (e.g., the first opening 108) and/or the opening 110 of the MEMS sensor device 104 (e.g., the second opening 110). A blockage condition can be associated with an obstruction of at least a portion of the opening 108 of the device 102 (e.g., the first opening 108) and/or the opening 110 of the MEMS sensor device 104 (e.g., the second opening 110) that form an audio port (e.g., an audio path) for the MEMS acoustic sensor of the MEMS sensor device 104. A blockage condition can be caused, for example, by a user (e.g., a hand of a user, a finger of a user, etc.), an object (e.g., a table, a particle of clothing, etc.), foreign material (e.g., dirt, food, liquid, etc.) and/or another type of obstruction. Therefore, a blockage condition can result in decreased performance and/or accuracy of the MEMS sensor device 104 with respect to normal operating conditions of the MEMS sensor device 104.

The processor 106 can detect a blockage condition associated with the MEMS sensor device 104 (e.g., the MEMS acoustic sensor of the MEMS sensor device 104) based on a change in one or more characteristics associated with the MEMS sensor device 104 (e.g., the MEMS acoustic sensor of the MEMS sensor device 104) in response to the acoustic signal. For example, the processor 106 can detect a blockage condition associated with the MEMS sensor device 104 based on a change in one or more characteristics associated with an output level of the MEMS sensor device 104 in response to the acoustic signal. In an aspect, the processor 106 can detect a blockage condition associated with the MEMS sensor device 104 based on a signature pattern of the MEMS sensor device 104 in response to the acoustic signal. For example, the processor 106 can determine that a blockage condition associated with the MEMS sensor device 104 exists in response to identifying a particular signature pattern associated with the MEMS sensor device 104. A signature pattern can be associated with a set of data corresponding to a blockage condition and/or one or more characteristics of a set of data corresponding to a blockage condition.

In another aspect, the processor 106 can detect a blockage condition associated with the MEMS sensor device 104 (e.g., the MEMS acoustic sensor of the MEMS sensor device 104) based on a change in sensitivity (e.g., a sensitivity drop) associated with the MEMS sensor device 104 (e.g., the MEMS acoustic sensor of the MEMS sensor device 104) in response to the acoustic signal. In one example, the processor 106 can detect a blockage condition associated with the MEMS sensor device 104 based on at least one frequency response curve (e.g., transfer function, frequency response pattern, etc.) associated with the MEMS sensor device 104. The processor 106 can detect a blockage condition associated with the MEMS sensor device 104, for example, based on a shift of a resonant peak associated with the MEMS sensor device 104 in response to the acoustic signal. In another example, the processor 106 can determine that a blockage condition associated with the MEMS sensor device 104 exists in response to a determination that a sensitivity value (e.g. sound field strength, ratio of an output value to input pressure, a gain value, a decibel value, a volts/pascal value, etc.) associated with the MEMS sensor device 104 has changed by a certain amount. However, it is to be appreciated that the processor 106 can employ a different technique to detect a change in sensitivity (e.g., a sensitivity drop) associated with the MEMS sensor device 104.

In yet another aspect, the processor 106 can detect a blockage condition associated with the MEMS sensor device 104 (e.g., the MEMS acoustic sensor of the MEMS sensor device 104) in response to determining that an external sound source is discontinued (e.g., no longer exists). For example, the processor 106 can determine that a blockage condition associated with the MEMS sensor device 104 exists in response to a determination that sensing of the acoustic signal is discontinued (e.g., in response to a determination that the acoustic signal is no longer sensed by the MEMS sensor device 104). Other MEMS sensor devices 104 of the device 102 can also be employed, for example, to determine whether the acoustic signal is still being received by the device 102 (e.g., received by other MEMS sensor devices 104 of the device 102).

Additionally or alternatively, the processor 106 can detect a blockage condition associated with the MEMS sensor device 104 (e.g., the MEMS acoustic sensor of the MEMS sensor device 104) based on a signal (e.g., a test acoustic signal) generated by the device 102. In one example, the signal (e.g., the test acoustic signal) can be generated by another MEMS sensor device. However, it is to be appreciated that the signal (e.g., the test acoustic signal) can be generated by different component(s) of the device 102. A signal (e.g., a test acoustic signal) generated by the device 102 can be associated with a particular waveform (e.g., a test waveform, etc.). Additionally or alternatively, a signal (e.g., a test acoustic signal) generated by the device 102 can be generated at a defined frequency. Accordingly, the processor 106 can determine whether a blockage condition associated with the MEMS sensor device 104 exists based on a comparison between at least one characteristic of the MEMS sensor device 104 that is determined in response to the signal (e.g., the test acoustic signal) and at least one expected characteristic of the MEMS sensor device 104. A difference (e.g., a certain degree of variance) between the at least one at least one characteristic and at least one expected characteristic can correspond to a blockage condition associated with the MEMS sensor device 104. Therefore, in one example, the acoustic signal associated with the MEMS sensor device 104 can be a test acoustic signal generated by the device 102. Additionally or alternatively, the processor 106 can detect a blockage condition associated with the MEMS sensor device 104 based on a proximity sensor associated with the MEMS sensor device 104. For example, a proximity sensor associated with the MEMS sensor device 104 can detect whether there is an obstruction associated with the opening 108 of the device 102 (e.g., the first opening 108) and/or the opening 110 of the MEMS sensor device 104 (e.g., the second opening 110).

The processor 106 can additionally or alternatively detect a blockage condition associated with the MEMS sensor device 104 (e.g., the MEMS acoustic sensor of the MEMS sensor device 104) based on a signal (e.g., a test electrical signal) generated by the processor 106. For example, the processor 106 can generate an electrical signal (e.g. a pulse) that can be received by the MEMS sensor device 104 (e.g., the MEMS acoustic sensor of the MEMS sensor device 104). In response to the electrical signal generated by the processor 106, a membrane associated with the MEMS acoustic sensor of the MEMS sensor device 104 will vibrate (e.g., a certain "characteristic" vibration of the membrane will be generated). Accordingly, vibration of the membrane associated with the MEMS acoustic sensor of the MEMS sensor device 104 can be converted into another electrical signal. The other electrical signal associated with the vibration of the membrane (e.g., the membrane associated with the MEMS acoustic sensor of the MEMS sensor device 104) can be received by the processor 106. The processor 106 can then process the other electrical signal associated with the vibration of the membrane and/or can determine whether a blockage condition is associated with the MEMS sensor device 104 (e.g., the MEMS acoustic sensor of the MEMS sensor device 104) based on the other electrical signal associated with the vibration of the membrane. For example, the processor 106 can detect a blockage condition based on at least one characteristic of the other electrical signal associated with the vibration of the membrane (e.g., the processor 106 can determine whether the other electrical signal associated with the vibration of the membrane is associated with a characteristic corresponding to a normal operating condition (e.g., no blockage), the processor 106 can determine whether the other electrical signal associated with the vibration of the membrane is associated with a shift in amplitude and/or frequency corresponding to a blockage condition, etc.). Therefore, the processor 106 can be employed (e.g., can generate a test electrical signal) to "self-test" behavior of the MEMS sensor device 104 (e.g., the MEMS acoustic sensor of the MEMS sensor device 104).

In an aspect, the processor 106 can determine whether a blockage condition associated with the MEMS sensor device 104 exists during a test mode (e.g., a diagnostic mode) associated with the device 102. The processor 106 can perform, for example, one or more blockage tests to determine whether a blockage condition associated with the MEMS sensor device 104 exists. In one example, the processor 106 can determine whether a blockage condition associated with the MEMS sensor device 104 exists (e.g., can perform one or more blockage tests) in response to the device 102 turning on (e.g., powering on) or a display associated with the device 102 turning on. In another example, the processor 106 can determine whether a blockage condition associated with the MEMS sensor device 104 exists (e.g., can perform one or more blockage tests) at certain intervals of time (e.g., every hour, every ten minutes, once a day, etc.). In yet another example, the processor 106 can determine whether a blockage condition associated with the MEMS sensor device 104 exists (e.g., can perform one or more blockage tests) in response to initiation or usage of a certain application associated with the device 102 (e.g., a phone application being opened on the device 102, while a phone application associated with the device 102 is being used, etc.). In yet another example, the processor 106 can continuously determine whether a blockage condition associated with the MEMS sensor device 104 exists or can continuously determine whether a blockage condition associated with the MEMS sensor device 104 exists over a certain interval of time.

The processor 106 can generate one or more signals and/or perform various functions associated with a blockage condition in response to determining that a blockage condition associated with the MEMS sensor device 104 exists. For instance, the processor 106 can send a data signal associated with a blockage condition to one or more application processors of the device 102, one or more system processors of the device 102, one or more system codecs of the device 102, and/or one or more external devices associated with the MEMS sensor device 104. Additionally or alternatively, the processor 106 can perform one or more functions associated with the MEMS sensor device 104 and/or one or more other components associated with the device 102. Accordingly, quality, performance and/or accuracy of the MEMS sensor device 104 can be improved. The processor 106 can also be configured to distinguish between a blockage condition (e.g., an unintentional blockage condition) and an intentional blockage condition associated with the device 102 and/or the MEMS sensor device 104 (e.g., a user tapping on the device 102 to "wake up" the device 102, etc.). For example, the processor 106 can generate one or more different signals and/or can perform one or more different functions (e.g., alter a power mode of the device 102, etc.) in response to detecting an intentional blockage condition associated with the device 102 and/or the MEMS sensor device 104.

Aspects of the processor 106 can constitute machine-executable component(s) embodied within machine(s), e.g., embodied in one or more computer readable mediums (or media) associated with one or more machines. Such component, when executed by the one or more machines, e.g., computer(s), computing device(s), virtual machine(s), etc. can cause the machine(s) to perform operations described herein in connection with detecting a blockage condition associated with the MEMS sensor device 104. In an embodiment, the processor 106 can be associated with a memory (e.g., memory 112 or another memory) for storing computer executable components and instructions, and the processor 106 can facilitate operation of the instructions (e.g., computer executable components and instructions). In an aspect, the memory 112 can store information associated with the MEMS sensor device 104 (e.g., the MEMS acoustic sensor of the MEMS sensor device 104). For example, the information associated with the MEMS sensor device 104 can include, but is not limited to, characteristic information associated with the MEMS sensor device 104, MEMS sensor characteristic data, information associated with the MEMS sensor device 104 under certain conditions (e.g., normal operating conditions that are not associated with a blockage condition, etc.), one or more signature patterns associated with the MEMS sensor device 104, sensitivity data associated with the MEMS sensor device 104, one or more frequency response curves (e.g., transfer functions, frequency response patterns, etc.) associated with the MEMS sensor device 104, other type of information associated with the MEMS sensor device 104, etc. The information stored in the memory 112 (e.g., the information associated with the MEMS sensor device 104) can be provided by the MEMS sensor device 104, the processor 106 and/or another component of the device 102. Additionally or alternatively, the information associated with the MEMS sensor device 104 can be stored in the memory 112 during testing of the device (e.g., factory testing, device testing, etc.). Therefore, the processor 106 can determine a blockage condition associated with the MEMS sensor device 104 (e.g., detect one or more changes associated with the MEMS sensor device 104) based on the information stored in the memory 112 (e.g., the information associated with the MEMS sensor device 104). For example, the processor 106 can employ the information stored in the memory 112 (e.g., the information associated with the MEMS sensor device 104 such as MEMS sensor characteristic data, etc.) as a reference to determine a blockage condition (e.g., detect one or more changes associated with the MEMS sensor device 104). It is to be appreciated that the device 102 can include more than one MEMS sensor device 104 and/or more than one processor 106. Therefore, the acoustic signal can be received by the device 102 at more than opening of the device 102. Furthermore, a blockage condition can be associated with more than one MEMS sensor device 104 of the device 102.

Figure 2:
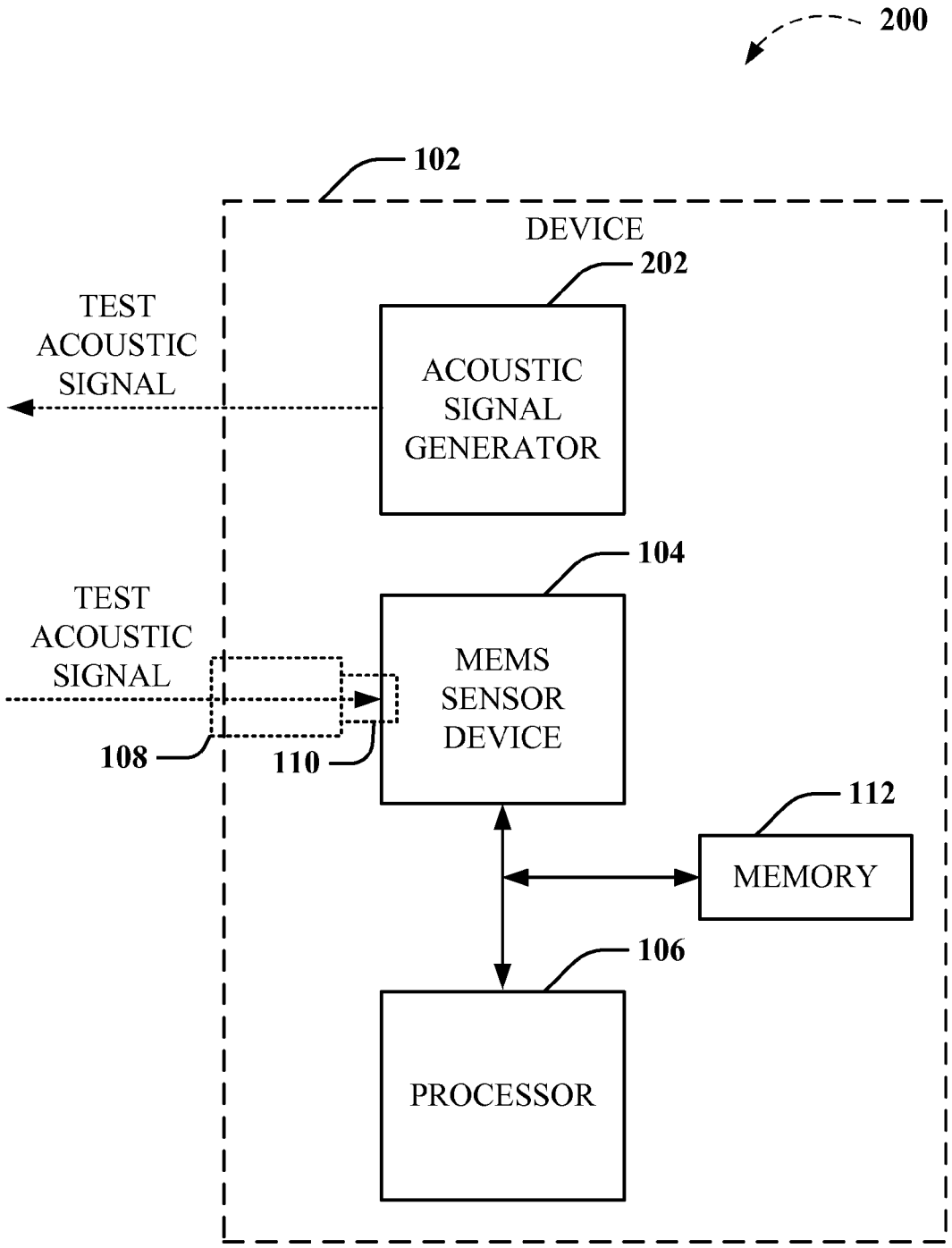
FIG. 2 depicts a functional block diagram of a system for detecting blockage associated with a MEMS sensor based on a test signal, in accordance with various aspects and implementations described herein.

FIG. 2 depicts a functional block diagram of a system 200 for detecting blockage associated with a MEMS microphone based on a test signal, according to various non-limiting aspects of the subject disclosure. System 200 includes the device 102. The device can include the MEMS sensor device 104, the processor 106 and an acoustic signal generator 202. The acoustic signal generator 202 can generate a test acoustic signal (e.g., TEST ACOUSTIC SIGNAL shown in FIG. 2). The MEMS sensor device 104 can receive the test acoustic signal generated by the acoustic signal generator 202. In an aspect, the device 102 can employ the acoustic signal generator 202 during a self-test mode.

In one example, the acoustic signal generator 202 can be another MEMS sensor device 104. For example, a MEMS acoustic sensor of another MEMS sensor device 104 (e.g., the acoustic signal generator 202) can generate the test acoustic signal. The MEMS acoustic sensor of the other MEMS sensor device (e.g., the acoustic signal generator 202) can be contained in another cavity within the device 102. Furthermore, the other MEMS sensor device (e.g., the acoustic signal generator 202) can be associated with another opening 108 and another opening 110. In another example, the acoustic signal generator 202 can be a speaker (e.g., a main speaker, etc.) of the device 102. The acoustic signal generator 202 can generate the test acoustic signal, for example, by altering one or more electrical conditions associated with the acoustic signal generator 202. For example, the acoustic signal generator 202 can generate the test acoustic signal by resonating a diaphragm associated with the acoustic signal generator 202. However, it is to be appreciated that the acoustic signal generator 202 can generate the test acoustic signal based on a different technique.

The device 102 can receive the test acoustic signal via the opening 108 associated with the MEMS sensor device 104 (e.g., the first opening 108). The MEMS sensor device 104 can further receive the test acoustic signal via the opening 110 of the MEMS sensor device 104 (e.g., the second opening 110). For example, the MEMS acoustic sensor of the MEMS sensor device 104 can receive the test acoustic signal via the opening 110 of the MEMS sensor device 104 (e.g., the second opening 110). The test acoustic signal generated by the acoustic signal generator 202 can be generated outside a hearing range of a user associated with the device 102. In one example, the test acoustic signal can be an ultrasonic test signal. In another example, the test acoustic signal can be associated with a particular waveform (e.g., a test waveform, a defined waveform, a predetermined waveform, etc.) and/or a particular frequency (e.g., a defined frequency, etc.). In yet another example, the test acoustic signal can be associated with an inaudible pattern.

In an aspect, the processor 106 can detect a blockage condition associated with the MEMS sensor device 104 (e.g., the MEMS acoustic sensor of the MEMS sensor device 104) based on a change in one or more characteristics associated with the MEMS sensor device 104 (e.g., the MEMS acoustic sensor of the MEMS sensor device 104) in response to the test acoustic signal generated by the acoustic signal generator 202. A change in one or more characteristics associated with the MEMS sensor device 104 can include, for example, a change in one or more characteristics of an output level associated with the MEMS sensor device 104. In another aspect, the processor 106 can detect a blockage condition associated with the MEMS sensor device 104 (e.g., the MEMS acoustic sensor of the MEMS sensor device 104) based on a change in sensitivity (e.g., a sensitivity drop) associated with the MEMS sensor device 104 (e.g., the MEMS acoustic sensor of the MEMS sensor device 104) in response to the test acoustic signal generated by the acoustic signal generator 202. In one example, the processor 106 can detect a blockage condition associated with the MEMS sensor device 104 based on at least one frequency response curve (e.g., a transfer function) associated with the MEMS sensor device 104. For example, the processor 106 can detect a blockage condition associated with the MEMS sensor device 104 based on a shift of a resonant peak associated with the MEMS sensor device 104 (e.g., a resonant peak associated with an output level of the MEMS sensor device 104) in response to the test acoustic signal generated by the acoustic signal generator 202.

The test acoustic signal generated by the acoustic signal generator 202 can be associated with a particular waveform (e.g., a test waveform, a defined waveform, a predetermined waveform, etc.). Therefore, the processor 106 can compare one or more predetermined characteristics of the MEMS sensor device 104 with one or more characteristics of the MEMS sensor device 104 that are determined in response to the test acoustic signal associated with the particular waveform (e.g., the test waveform, the defined waveform, the predetermined waveform, etc.). Additionally or alternatively, the acoustic signal generator 202 can generate the test acoustic signal at a particular frequency (e.g., a defined frequency). An acoustic signal sensed by the MEMS sensor device 104 (e.g., sensed by a MEMS acoustic sensor of the MEMS sensor device 104) is a function of the frequency of sound received by the MEMS sensor device 104. For example, for a given frequency, the MEMS sensor device 104 comprises a particular signal output. Therefore, the processor 106 can additionally or alternatively compare one or more predetermined characteristics of the MEMS sensor device 104 that are determined based on an acoustic signal at a particular frequency (e.g., a defined frequency) with one or more characteristics of the MEMS sensor device 104 that are determined in response to the test acoustic signal generated at the particular frequency (e.g., the defined frequency). The comparison of the one or more predetermined characteristics of the MEMS sensor device 104 with the one or more characteristics of the MEMS sensor device 104 in response to the test acoustic signal (e.g., detection of a change in MEMS characteristics of the MEMS sensor device 104) can facilitate determining whether a blockage condition associated with the MEMS sensor device 104 exists.

Figure 3:
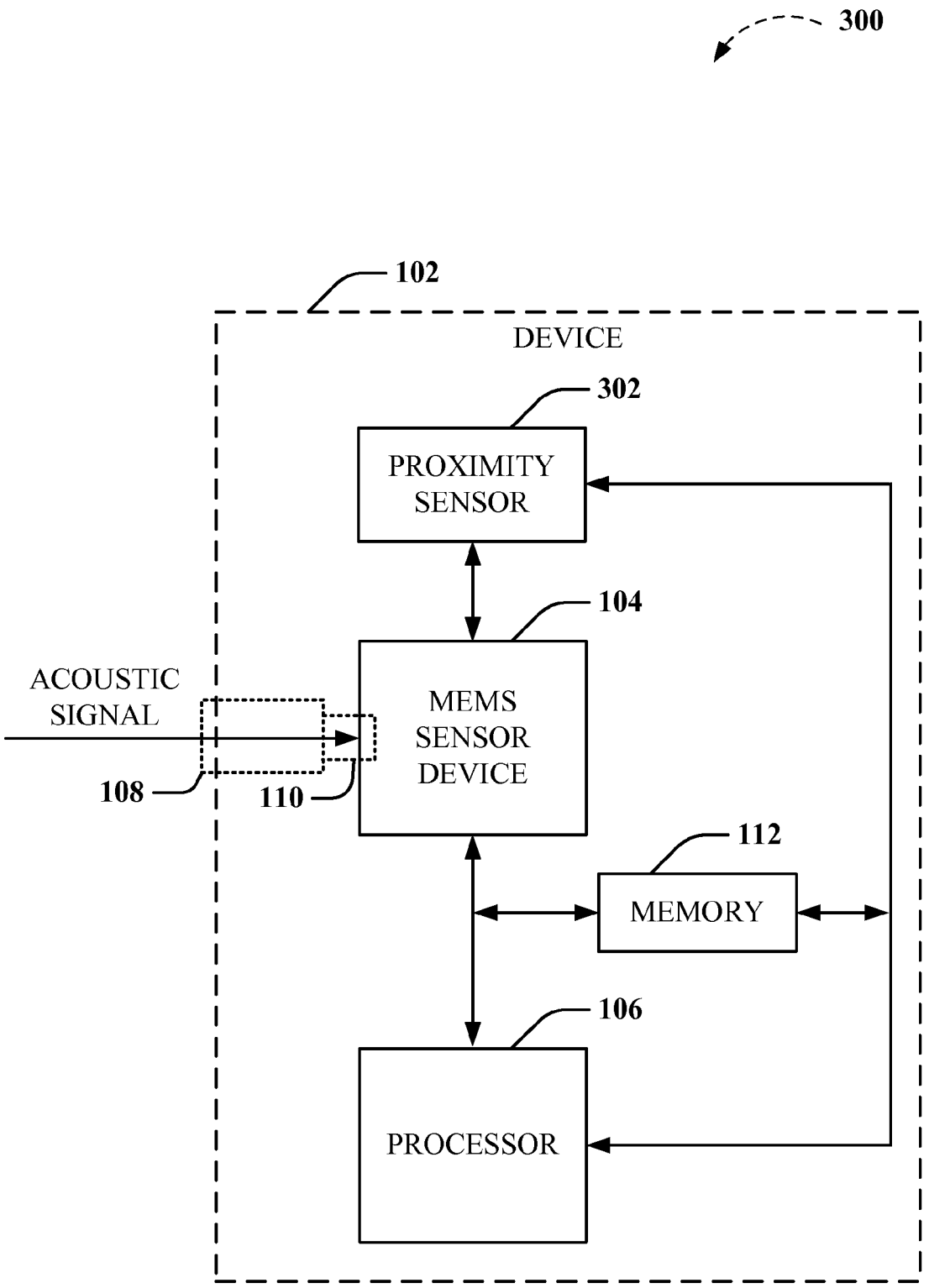
FIG. 3 depicts a functional block diagram of a system for detecting blockage associated with a MEMS sensor based on a proximity sensor, in accordance with various aspects and implementations described herein.

FIG. 3 depicts a functional block diagram of a system 300 for detecting blockage associated with a MEMS microphone based on a proximity sensor, according to various non-limiting aspects of the subject disclosure. System 300 includes the device 102. The device 102 can include the MEMS sensor device 104, the processor 106 and a proximity sensor 302. It is to be appreciated that the device 102 shown in FIG. 3 can also include the acoustic signal generator 202.

The proximity sensor 302 can be associated with the MEMS sensor device 104. In one example, the proximity sensor 302 can be associated with the opening 108 of the device 102 (e.g., the first opening 108) and/or the opening 110 of the MEMS sensor device 104 (e.g., the second opening 110). The proximity sensor 302 can be configured to detect presence of an object associated with the opening 108 of the device 102 (e.g., the first opening 108) and/or the opening 110 of the MEMS sensor device 104 (e.g., the second opening 110). For example, the proximity sensor 302 can employ reflection (e.g., reflected light, infrared light, etc.) to detect presence of an object associated with the opening 108 of the device 102 (e.g., the first opening 108) and/or the opening 110 of the MEMS sensor device 104 (e.g., the second opening 110). Therefore, the processor 106 can additionally or alternatively detect a blockage condition associated with the MEMS sensor device 104 based on the proximity sensor 302 (e.g., data generated by the proximity sensor 302). In an embodiment, the proximity sensor 302 can be a implemented separate from the MEMS sensor device 104. In another embodiment, the MEMS sensor device 104 can include the proximity sensor 302. For example, the MEMS sensor device 104 (e.g., a MEMS acoustic microphone) can be configured as a proximity sensor. Therefore, the MEMS sensor device 104 (e.g., a MEMS acoustic microphone) can generate a signal in response to an electrical signal (e.g., the MEMS sensor device 104 can be excited by an electrical signal), the MEMS sensor device 104 (e.g., a MEMS acoustic microphone) can transmit the signal and/or the MEMS sensor device 104 (e.g., a MEMS acoustic microphone) can receive feedback associated with the signal (e.g., an echo of the signal, etc.) to detect presence of an object associated with the opening 108 of the device 102 (e.g., the first opening 108) and/or the opening 110 of the MEMS sensor device 104 (e.g., the second opening 110). Alternatively, feedback associated with a signal (e.g., an echo of a signal, etc.) generated in response to an electrical signal can be received by another MEMS sensor device of the device 102.

The processor 106, the acoustic signal generator 202 and/or the proximity sensor 302 can each be associated with one or more blockage tests employed to detect and/or verify a blockage condition associated with the MEMS sensor device 104 (e.g., a blockage condition associated with the opening 108 and/or the opening 110). In an aspect, the processor 106, the acoustic signal generator 202 and/or the proximity sensor 302 can be employed to detect and/or verify a blockage condition associated with the MEMS sensor device 104 (e.g., a blockage condition associated with the opening 108 and/or the opening 110). For example, features and/or functionality of the processor 106, the acoustic signal generator 202 and/or the proximity sensor 302 as more fully disclosed herein can be combined to detect and/or verify a blockage condition associated with the MEMS sensor device 104 (e.g., a blockage condition associated with the opening 108 and/or the opening 110).

Figure 4:
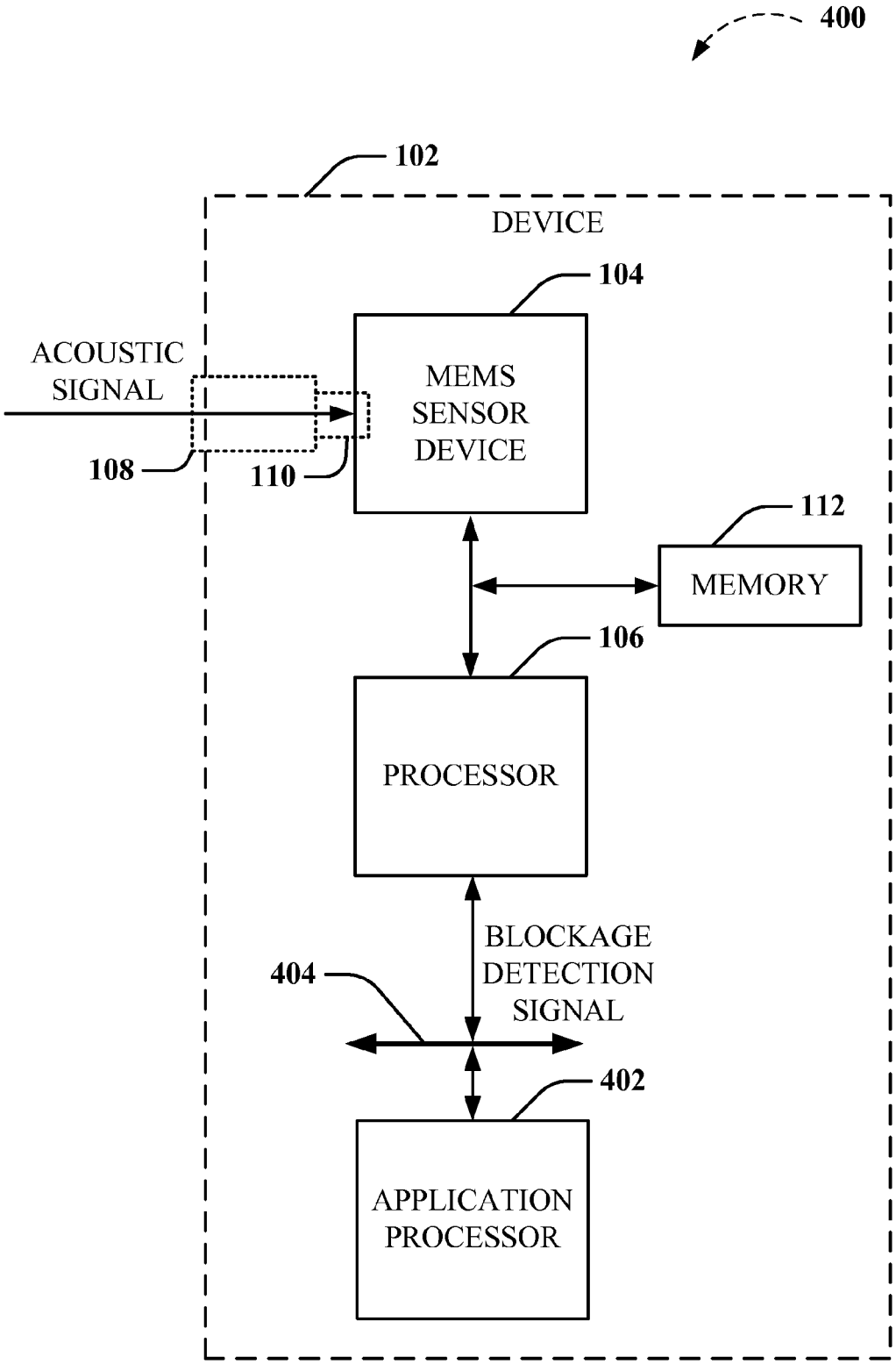
FIG. 4 depicts a functional block diagram of another system for detecting blockage associated with a MEMS sensor, in accordance with various aspects and implementations described herein.

FIG. 4 depicts a functional block diagram of a system 400 for detecting blockage associated with a MEMS microphone, according to various non-limiting aspects of the subject disclosure. System 400 includes the device 102. The device 102 can include the MEMS sensor device 104, the processor 106 and an application processor 402. In an aspect, the processor 106 can communicate with the application processor 402 via a communication bus 404. It is to be appreciated that the device 102 shown in FIG. 3 can also include the acoustic signal generator 202 and/or the proximity sensor 302.

The processor 106 can generate a blockage detection signal (e.g., BLOCKAGE DETECTION SIGNAL shown in FIG. 4) associated with a blockage condition in response to determining that a blockage condition associated with the MEMS sensor device 104 exists. The processor 106 can transmit the blockage detection signal to the application processor 402. The application processor 402 can perform one or more functions associated with the MEMS sensor device 104 and/or one or more other components of the device 102 in response to receiving the blockage detection signal. It is to be appreciated that the application processor 402 can include more than one processor. Furthermore, it is to be appreciated that the application processor 402 can additionally or alternatively include another type of processor such as, but not limited to, a system processor, a system codec, another type of processor of the device 102, etc. Accordingly, functionality of the MEMS sensor device 104 and/or one or more other components of the device 102 can be modified and/or one or more operations associated with the device 102 can be performed in response to the blockage detection signal being generated (e.g., in response to a determination by the processor 106 that a blockage condition exists).

FIG. 5 depicts a non-limiting embodiment of the MEMS sensor device 104. The MEMS sensor device 104 can include at least a MEMS acoustic sensor 502 (e.g., a MEMS acoustic microphone 502). For example, the MEMS sensor device 104 can be a sensor package (e.g., a microphone package). In an aspect, the MEMS sensor device 104 can comprise an enclosure comprising a substrate (e.g., a sensor or microphone package substrate) 504 and a lid 506 that can house and define a cavity 508 for the MEMS acoustic sensor 502. The enclosure comprising the substrate 504 and the lid 506 can comprise the opening 110 (e.g., the second opening 110). The opening 110 can be at least a portion of an audio port that is adapted to receive acoustic waves or acoustic pressure (e.g., the acoustic signal, the test acoustic signal, etc.). The opening 110 can alternatively be located in the lid 506 for other configurations of the MEMS sensor device 104. The MEMS acoustic sensor 502 can be mechanically affixed to the substrate 504 and can be communicably coupled thereto. In the embodiment depicted in FIG. 5, the processor 106 can be implemented separate from the MEMS sensor device 104 (e.g., outside the cavity 508). For example, the processor 106 can be communicably coupled to the MEMS acoustic sensor 502 via the substrate 504. The processor 106 can detect a blockage condition associated with at least the opening 110 and/or the MEMS acoustic sensor 502, as more fully disclosed herein.

FIG. 6 depicts another non-limiting embodiment of the MEMS sensor device 104. In the embodiment depicted in FIG. 6, the processor 106 can be included in the MEMS sensor device 104 (e.g., within the cavity 508). For example, in certain implementations, the MEMS sensor device 104 can also comprise the processor 106 and/or an application-specific integrated circuit (ASIC) 602. The processor 106 and/or the ASIC 602 can be housed in the enclosure comprising the MEMS acoustic sensor 502 and the lid 506. In the MEMS sensor device 104 depicted in FIG. 6, the processor 106 can be integrated with the ASIC 602. The ASIC 602 can be mechanically affixed to the substrate 504. Additionally, the ASIC 602 and can be communicably coupled to the MEMS acoustic sensor 502 via the substrate 504. However, in another implementation, the processor 106 can be a standalone component. For example, the MEMS acoustic sensor 502 and a standalone processor 106 can be communicably coupled and mechanically affixed on top of the substrate 504. In yet another implementation, the MEMS acoustic sensor 502 can be communicably coupled and mechanically affixed to the ASIC 602 in addition to the processor 106 or instead of the processor 106. However, it is to be appreciated that the MEMS acoustic sensor 502, the ASIC 602 and/or the processor 106 can be implemented in the MEMS sensor device 104 in a different manner.

FIG. 7 illustrates a schematic cross section of a system 700 comprising exemplary MEMS sensor device 104 integrated with the device 102, according to various aspects of the subject disclosure. System 700 can include the MEMS acoustic sensor 502 in an enclosure comprising the substrate 504 and the lid 510 that can house and define the cavity 508 for the MEMS acoustic sensor 502. As above, the enclosure comprising the substrate 504 and the lid 510 can comprise the opening 110, or otherwise, adapted to receive acoustic waves or acoustic pressure (e.g., the acoustic signal, the test acoustic signal). The substrate 504 can be connected to an external substrate 702 such as a printed circuit board (PCB) of the device 102 or a case of the device 102. For example, solder on the substrate 504 can facilitate connecting a MEMS sensor device 104 (e.g., the MEMS acoustic sensor 502, the substrate 504 and/or the lid 510) to the external substrate 702. The external substrate 702 (e.g., a PCB of the device 102, a case of the device 102, etc.) can comprise the opening 108. As such, acoustic waves or acoustic pressure (e.g., the acoustic signal, the test acoustic signal) can reach the MEMS acoustic sensor 502 via the opening 108 and the opening 110 (e.g., an audio port formed by the opening 108 and the opening 110). The processor 106 can detect a blockage condition associated with at least the opening 108, the opening 110 and/or the MEMS acoustic sensor 502, as more fully disclosed herein.

Figure 8:
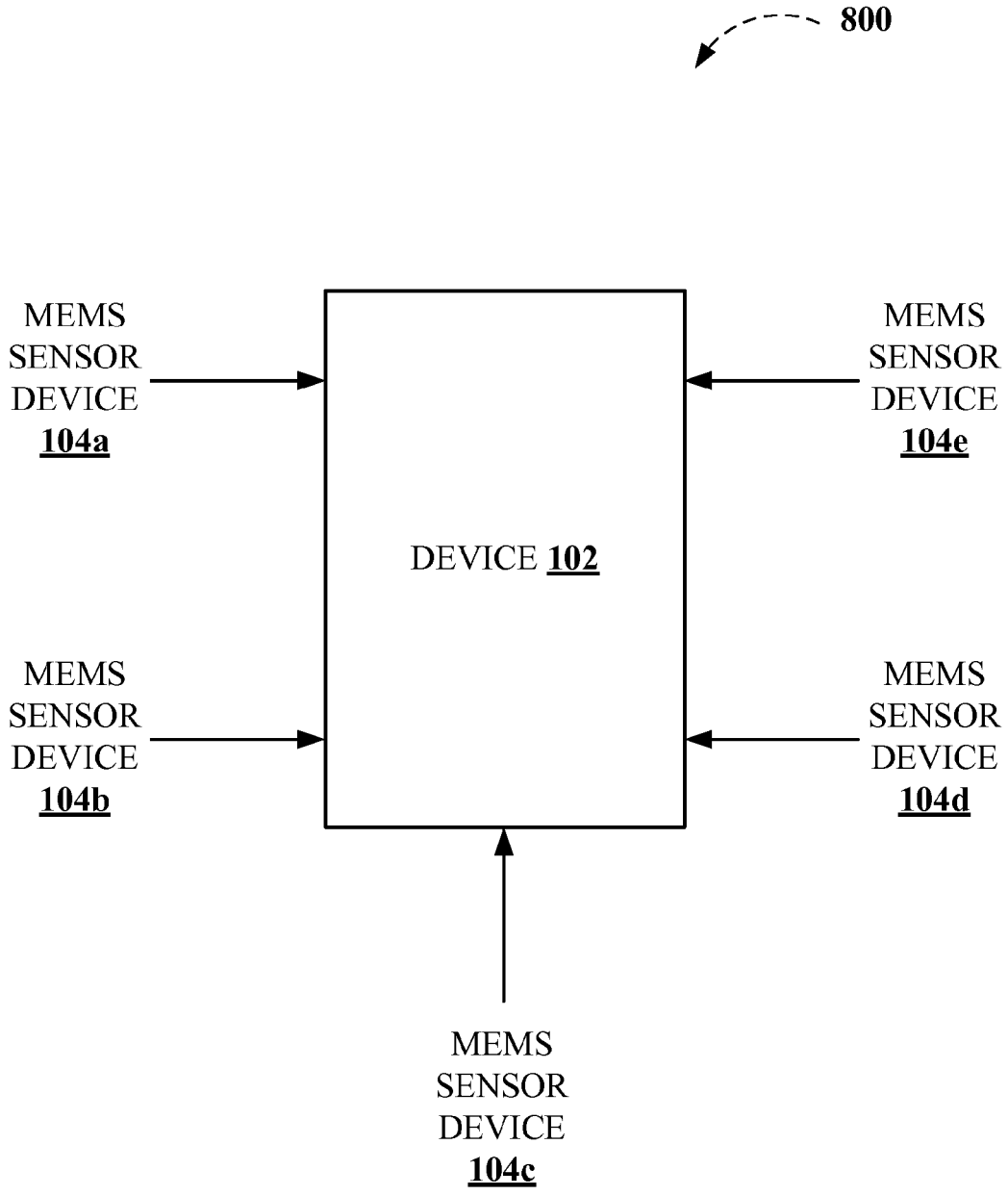
FIG. 8 depicts a non-limiting example of a device implementing a plurality of MEMS sensor devices, in accordance with various aspects and implementations described herein.

FIG. 8 illustrates an exemplary system 800 comprising the device 102, according to various aspects of the subject disclosure. In the exemplary system 800 depicted in FIG. 8, the device 102 can comprise a plurality of MEMS sensor devices. For example, the device 102 can comprise a MEMS sensor device 104*a*, a MEMS sensor device 104*b*, a MEMS sensor device 104*c*, a MEMS sensor device 104*d* and/or a MEMS sensor device 104*e*. Each of the MEMS sensor devices 104*a-e* can function as more fully disclosed herein. One or more processors of the device 102 (e.g., a processor 106) can determine whether the MEMS sensor device 104*a*, the MEMS sensor device 104*b*, the MEMS sensor device 104*c*, the MEMS sensor device 104*d* and/or the MEMS sensor device 104*e* is associated with a blockage condition, as more fully disclosed herein. In a non-limiting example, a single processor 106 can be associated with the MEMS sensor devices 104*a-e*. In another non-limiting example, each of the MEMS sensor devices 104*a-e* can be associated with a processor 106. In an aspect, one or more of the MEMS sensor devices 104*a-e* can be configured as an acoustic signal generator (e.g., an acoustic signal generator 202). In a non-limiting example, the MEMS sensor device 104*a* can generate a test acoustic signal that can be received by the MEMS sensor device 104*b*, the MEMS sensor device 104*c*, the MEMS sensor device 104*d* and/or the MEMS sensor device 104*e*.

Figure 9:
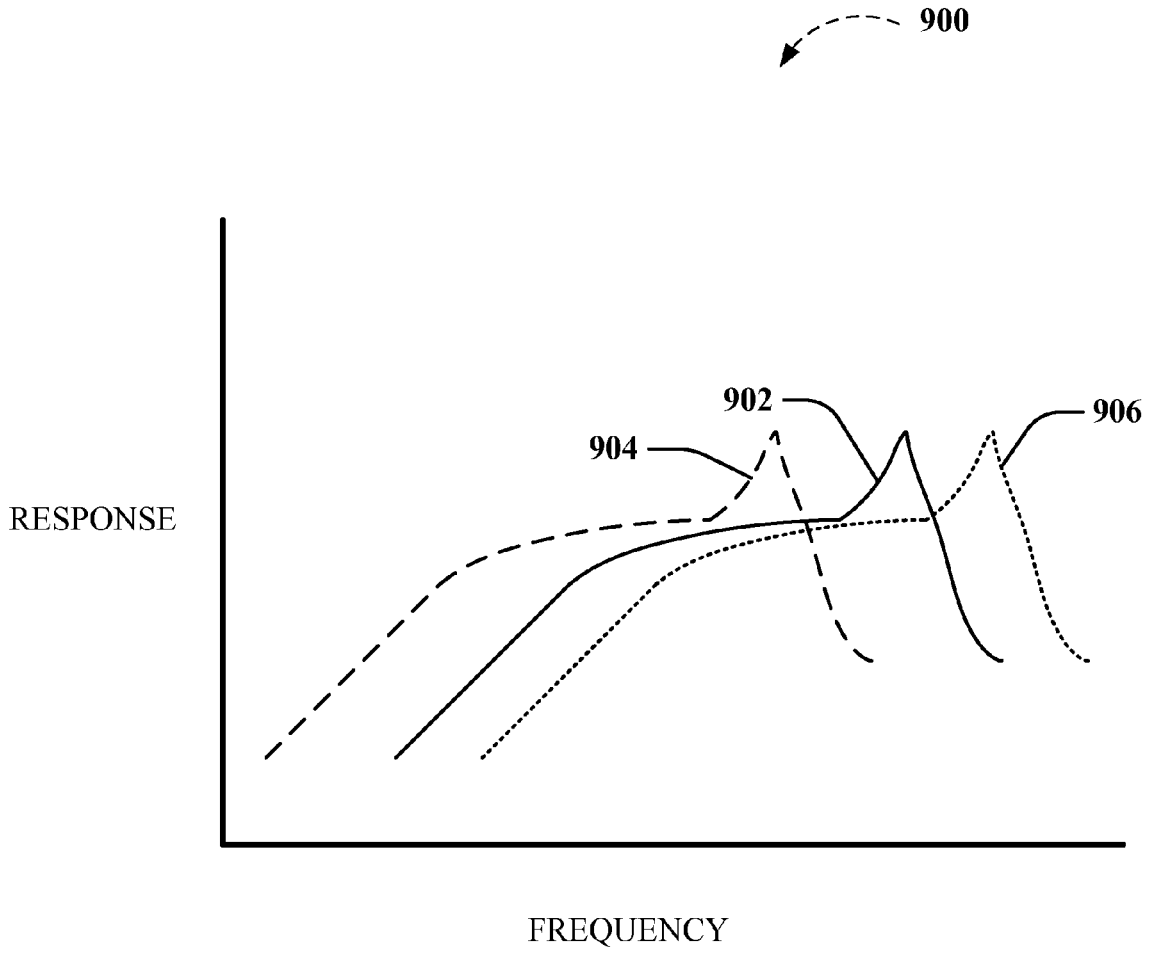
FIG. 9 depicts a non-limiting example of a frequency response chart associated with a MEMS sensor device, in accordance with various aspects and implementations described herein.

FIG. 9 illustrates an exemplary frequency response chart 900 associated with a MEMS sensor device (e.g., MEMS sensor device 104, MEMS acoustic sensor 502, etc.), according to various aspects of the subject disclosure. The frequency response chart 900 can illustrate data values associated with a MEMS sensor device (e.g., response shown in the y-axis of the frequency response chart 900) in comparison to changes in frequency (e.g., frequency shown in the x-axis of the frequency response chart 900). A frequency response curve 902, a frequency response curve 904 and a frequency response curve 906 included in the frequency response chart 900 can be exemplary frequency response curves associated with a MEMS sensor device (e.g., MEMS sensor device 104, MEMS acoustic sensor 502, etc.) in response to a signal (e.g., an acoustic signal, a test acoustic signal, etc.). For example, the frequency response curve 902, the frequency response curve 904 and the frequency response curve 906 can be exemplary frequency response curves associated with an output level or sensitivity of a MEMS sensor device (e.g., MEMS sensor device 104, MEMS acoustic sensor 502, etc.). In a non-limiting example, the frequency response curve 902 can represent a frequency response (e.g., a resonant peak) associated with a normal operating condition of a MEMS sensor device (e.g., MEMS sensor device 104, MEMS acoustic sensor 502, etc.), the frequency response curve 904 can represent a shifted resonant peak associated with a blockage condition of a MEMS sensor device (e.g., MEMS sensor device 104, MEMS acoustic sensor 502, etc.), and the frequency response curve 906 can represent a different shifted resonant peak associated with a blockage condition of a MEMS sensor device (e.g., MEMS sensor device 104, MEMS acoustic sensor 502, etc.). Therefore, a processor (e.g., the processor 106) can determine that a blockage condition is associated with a MEMS sensor device (e.g., MEMS sensor device 104, MEMS acoustic sensor 502, etc.) in response to determining that the MEMS sensor device is associated with the frequency response curve 904 or the frequency response curve 906 (e.g., when the frequency response curve 902 is associated with a normal operating condition of the MEMS sensor device).

While various embodiments of blockage detection associated with a MEMS microphone according to aspects of the subject disclosure have been described herein for purposes of illustration, and not limitation, it can be appreciated that the subject disclosure is not so limited. Various implementations can be applied to other areas of microphone blockage detection, without departing from the subject matter described herein. For instance, it can be appreciated that other applications requiring microphone blockage detection can employ aspects of the subject disclosure. Furthermore, various exemplary implementations of the device 102 and the MEMS sensor device 104 as described can additionally, or alternatively, include other features or functionality of sensors, microphones, processors, microphone or processor packages, devices, components and so on, as further detailed herein, for example, regarding FIGS. 1-9.

In view of the subject matter described supra, methods that can be implemented in accordance with the subject disclosure will be better appreciated with reference to the flowcharts of FIGS. 10-14. While for purposes of simplicity of explanation, the methods are shown and described as a series of blocks, it is to be understood and appreciated that such illustrations or corresponding descriptions are not limited by the order of the blocks, as some blocks may occur in different orders and/or concurrently with other blocks from what is depicted and described herein. Any nonsequential, or branched, flow illustrated via a flowchart should be understood to indicate that various other branches, flow paths, and orders of the blocks, can be implemented which achieve the same or a similar result. Moreover, not all illustrated blocks may be required to implement the methods described hereinafter.

Exemplary Methods

Figure 10:
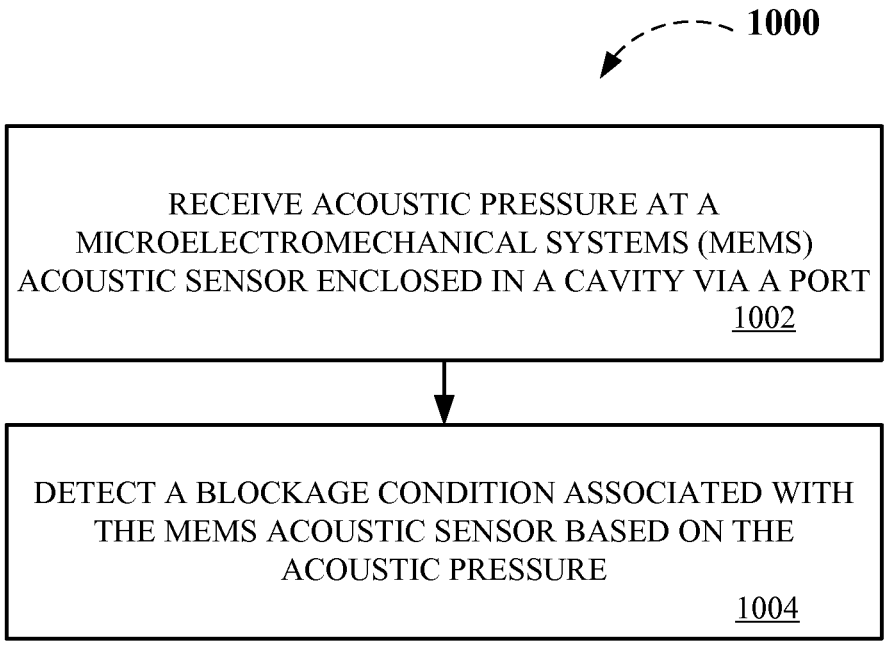
FIG. 10 is a flowchart of an example methodology for detecting microphone blockage, in accordance with various aspects and implementations described herein.

FIG. 10 depicts an exemplary flowchart of a non-limiting method 1000 for detecting microphone blockage, according to various non-limiting aspects of the subject disclosure. Initially, at 1002, acoustic pressure is received at a microelectromechanical systems (MEMS) acoustic sensor (e.g., a MEMS acoustic sensor 502 of a MEMS sensor device 104) enclosed in a cavity via a port. For example, a MEMS acoustic sensor enclosed in a cavity can receive an acoustic signal via an audio port associated with the MEMS acoustic sensor. The port (e.g., the audio port) can be formed by an opening of the cavity (e.g., opening 110) and/or an opening of a device that includes the MEMS acoustic sensor (e.g., opening 108).

At 1004, a blockage condition associated with the MEMS acoustic sensor is detected (e.g., by a processor 106) based on a signature pattern of the MEMS acoustic sensor in response to the acoustic pressure. The blockage condition can be caused by an obstruction of the port that limits (e.g., reduces) acoustic pressure received by the MEMS acoustic sensor. For example, a user (e.g., a hand of a user, a finger of a user, etc.), an object (e.g., a table, a particle of clothing, etc.) can obstruct the port and/or the MEMS acoustic sensor, foreign material (e.g., dirt, food, liquid, etc.) can obstruct the port and/or the MEMS acoustic sensor, etc. In an aspect, a blockage condition associated with the MEMS acoustic sensor can be detected based on a change in a one or more characteristics associated with the MEMS acoustic sensor (e.g., a change in one or more characteristics of an output level or sensitivity of the MEMS acoustic sensor) in response to the acoustic pressure.

Figure 11:
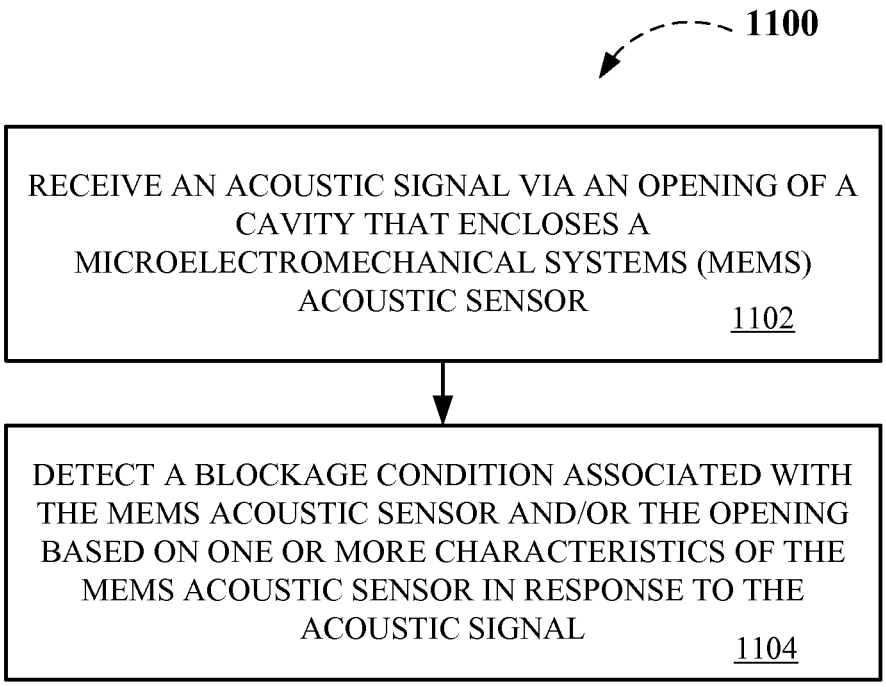
FIG. 11 is a flowchart of another example methodology for detecting microphone blockage, in accordance with various aspects and implementations described herein.

FIG. 11 depicts an exemplary flowchart of a non-limiting method 1100 for detecting microphone blockage, according to various non-limiting aspects of the subject disclosure. Initially, at 1102, an acoustic signal is received (e.g., by a MEMS sensor device 104) via an opening of a cavity that encloses a microelectromechanical systems (MEMS) acoustic sensor. For example, the opening of the cavity can form at least a portion of an audio port (e.g., an audio path) that allows the acoustic signal to reach the MEMS acoustic sensor.

At 1104, a blockage condition associated with the MEMS acoustic sensor and/or the opening is detected (e.g., by a processor 106) based on one or more characteristics of the MEMS acoustic sensor in response to the acoustic signal. For example, a blockage condition associated with the MEMS acoustic sensor and/or the opening can be detected based on a change in one or more characteristics of the MEMS acoustic sensor (e.g., a change in one or more characteristics of an output level or sensitivity of the MEMS acoustic sensor) in response to the acoustic signal. In one example, a change of a quantitative measure associated with output of the MEMS acoustic sensor (e.g., magnitude, phase, shape, etc.) in response to the acoustic signal can be employed to determine a blockage condition associated with the MEMS acoustic sensor and/or the opening. However, it is to be appreciated that a blockage condition associated with the MEMS acoustic sensor and/or the opening can be detected based on a change in other characteristics of the MEMS acoustic sensor in response to the acoustic signal. In an aspect, one or more predetermined characteristics of the MEMS acoustic sensor associated with normal operating conditions of the MEMS acoustic sensor can be compared to one or more characteristics of the MEMS acoustic sensor in response to the acoustic signal.

Figure 12:
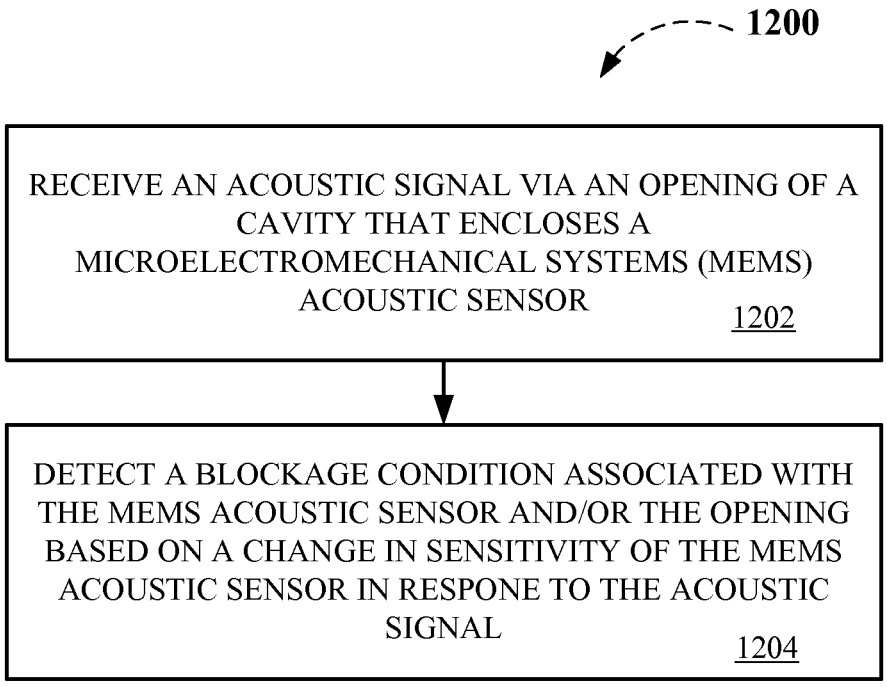
FIG. 12 is a flowchart of yet another example methodology for detecting microphone blockage, in accordance with various aspects and implementations described herein.

FIG. 12 depicts an exemplary flowchart of a non-limiting method 1200 for detecting microphone blockage, according to various non-limiting aspects of the subject disclosure. Initially, at 1202, an acoustic signal is received (e.g., by a MEMS sensor device 104) via an opening of a cavity that encloses a microelectromechanical systems (MEMS) acoustic sensor. At 1204, a blockage condition associated with the MEMS acoustic sensor and/or the opening is detected (e.g., by a processor 106) based on a change in sensitivity of the MEMS acoustic sensor in response to the acoustic signal. For example, a blockage condition associated with the MEMS acoustic sensor and/or the opening can be detected based on a sensitivity drop associated with the MEMS acoustic sensor in response to the acoustic signal. In one example, a blockage condition associated with the MEMS acoustic sensor and/or the opening can be detected based on at least one frequency response curve (e.g., a transfer function) associated with the MEMS acoustic sensor (e.g., output of the MEMS acoustic sensor). For example, a shift of a resonant peak associated with the MEMS acoustic sensor (e.g., output of the MEMS acoustic sensor) in response to the acoustic signal can correspond to a blockage condition. In another example, a certain amount of change of a sensitivity value (e.g. sound field strength, ratio of an output value to input pressure, a gain value, a decibel value, a volts/pascal value, etc.) associated with the MEMS acoustic sensor can correspond to a blockage condition.

Figure 13:
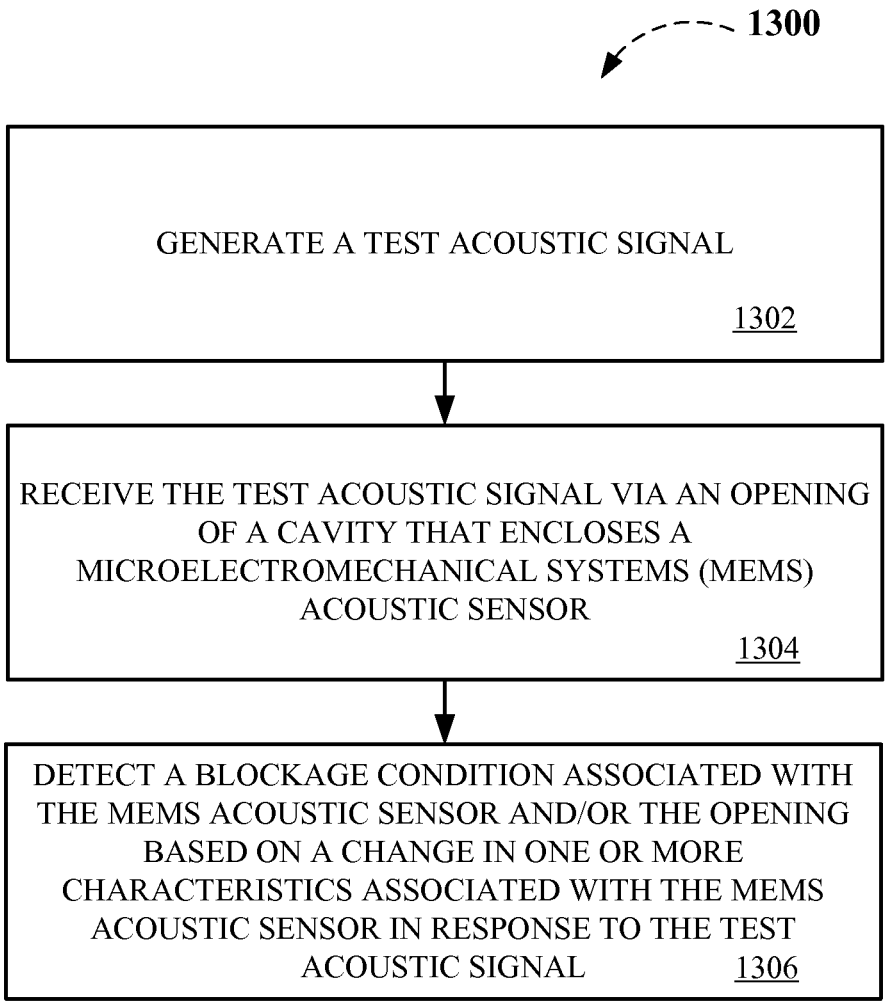
FIG. 13 is a flowchart of an example methodology for detecting microphone blockage based on a test signal, in accordance with various aspects and implementations described herein.

FIG. 13 depicts an exemplary flowchart of a non-limiting method 1300 for detecting microphone blockage based on a test signal, according to various non-limiting aspects of the subject disclosure. Initially, at 1302, a test acoustic signal is generated (e.g., by an acoustic signal generator 202). The test acoustic signal can be associated with a particular waveform (e.g., a defined waveform, a test waveform, etc.) and/or can be generated at a particular frequency (e.g., a defined frequency). Furthermore, the test acoustic signal can be generated outside a hearing range of a user. In one example, the test acoustic signal can be an ultrasonic test signal. In another example, the test acoustic signal can be associated with an inaudible pattern. At 1304, the test acoustic signal is received (e.g., by a MEMS sensor device 104) via an opening of a cavity that encloses a microelectromechanical systems (MEMS) acoustic sensor. For example, the opening of the cavity can form at least a portion of an audio port (e.g., an audio path) that allows the test acoustic signal to reach the MEMS acoustic sensor. At 1306, a blockage condition associated with the MEMS acoustic sensor and/or the opening is detected (e.g., by a processor 106) based on a change in one or more characteristics associated with the MEMS acoustic sensor in response to the test acoustic signal. For example, a blockage condition associated with the MEMS acoustic sensor and/or the opening can be detected based on a change in one or more characteristic of an output level or sensitivity associated with the MEMS acoustic sensor (e.g., output of the MEMS acoustic sensor) in response to the test acoustic signal. In an aspect, one or more predetermined characteristics of the MEMS acoustic sensor that are determined based on an acoustic signal (e.g., an acoustic signal associated with a waveform and/or a particular frequency) can be compared with the one or more characteristics of the MEMS acoustic sensor that are determined in response to the test acoustic signal (e.g., the test acoustic signal associated with a particular waveform and/or generated at the particular frequency associated with the acoustic signal).

Figure 14:
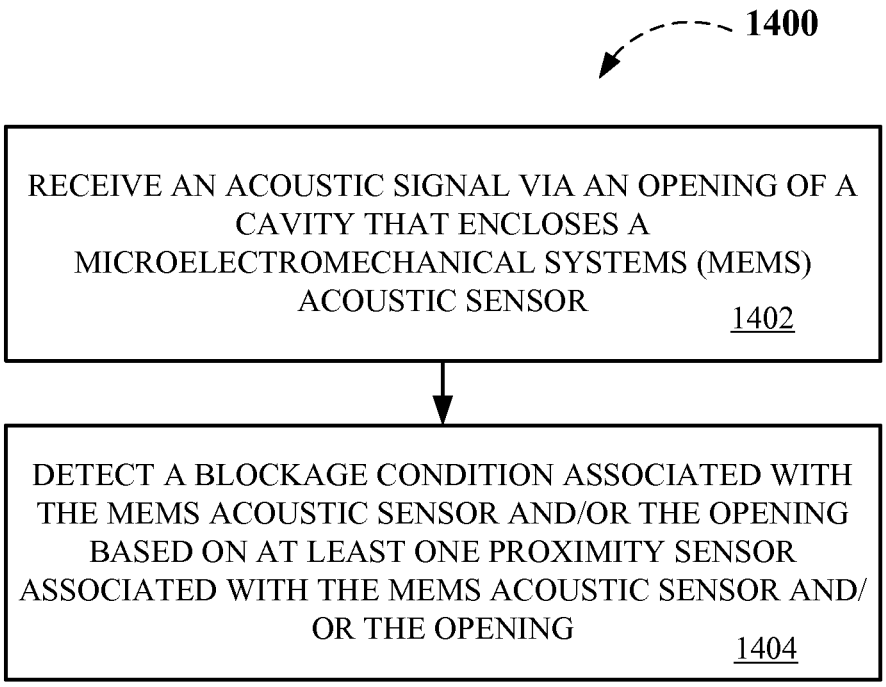
FIG. 14 is a flowchart of an example methodology for detecting microphone blockage based on a proximity sensor, in accordance with various aspects and implementations described herein.

FIG. 14 depicts an exemplary flowchart of a non-limiting method 1400 for detecting microphone blockage based on a proximity sensor, according to various non-limiting aspects of the subject disclosure. Initially, at 1402, an acoustic signal is received (e.g., by a MEMS sensor device 104) via an opening of a cavity that encloses a microelectromechanical systems (MEMS) acoustic sensor. At 1404, a blockage condition associated with the MEMS acoustic sensor and/or the opening is detected (e.g., by a processor 106) based on at least one proximity sensor associated with the MEMS acoustic sensor and/or the opening. For example, presence of an object associated with the opening of the cavity can be determined to facilitate detecting a blockage condition associated with the MEMS acoustic sensor and/or the opening.

It is to be appreciated that various exemplary implementations of exemplary methods 1000, 1100, 1200, 1300 and 1400 as described can additionally, or alternatively, include other process steps associated with features or functionality for blockage detection, as further detailed herein, for example, regarding FIGS. 1-9.

What has been described above includes examples of the embodiments of the subject disclosure. It is, of course, not possible to describe every conceivable combination of configurations, components, and/or methods for purposes of describing the claimed subject matter, but it is to be appreciated that many further combinations and permutations of the various embodiments are possible. Accordingly, the claimed subject matter is intended to embrace all such alterations, modifications, and variations that fall within the spirit and scope of the appended claims. While specific embodiments and examples are described in subject disclosure for illustrative purposes, various modifications are possible that are considered within the scope of such embodiments and examples, as those skilled in the relevant art can recognize.

As used in this application, the terms "component," "module," "device" and "system" are intended to refer to a computer-related entity, either hardware, a combination of hardware and software, software, or software in execution. As one example, a component or module can be, but is not limited to being, a process running on a processor, a processor or portion thereof, a hard disk drive, multiple storage drives (of optical and/or magnetic storage medium), an object, an executable, a thread of execution, a program, and/or a computer. By way of illustration, both an application running on a server and the server can be a component or module. One or more components or modules scan reside within a process and/or thread of execution, and a component or module can be localized on one computer or processor and/or distributed between two or more computers or processors.

As used herein, the term to "infer" or "inference" refer generally to the process of reasoning about or inferring states of the system, and/or environment from a set of observations as captured via events, signals, and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

In addition, the words "example" or "exemplary" is used herein to mean serving as an example, instance, or illustration. Any aspect or design described herein as "exemplary" is not necessarily to be construed as preferred or advantageous over other aspects or designs. Rather, use of the word, "exemplary," is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In addition, while an aspect may have been disclosed with respect to only one of several embodiments, such feature may be combined with one or more other features of the other embodiments as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A device, comprising:

a microelectromechanical systems (MEMS) acoustic sensor contained in a cavity within the device;

an acoustic signal generator configured to generate a test acoustic signal associated with a test waveform; and a processor configured to detect a blockage condition associated with an opening of the cavity that contains the MEMS acoustic sensor based on analysis of a resonant peak of an output associated with the MEMS acoustic sensor in response to the test acoustic signal being received via the opening of the cavity that contains the MEMS acoustic sensor, and to modify functionality of the MEMS acoustic sensor in response to a determination that the resonant peak satisfies a defined criterion.

2. The device of claim 1, wherein the processor is configured to detect the blockage condition based on at least one other characteristic of the output associated with the MEMS acoustic sensor in response to the test signal being received via the opening of the cavity that contains the MEMS acoustic sensor.

3. The device of claim 1, wherein the acoustic signal generator is configured to generate the test acoustic signal by altering one or more electrical conditions associated with the acoustic signal generator.

4. The device of claim 1, wherein the MEMS acoustic sensor is a first MEMS acoustic, and wherein the acoustic signal generator is a second MEMS acoustic sensor configured to generate the test acoustic signal by resonating a diaphragm associated with the second MEMS acoustic sensor.

5. The device of claim 1, wherein the processor is configured to detect the blockage condition based on frequency response of the MEMS acoustic sensor in response to the test acoustic signal.

6. The device of claim 1, wherein the processor is configured to detect the blockage condition based on a comparison between at least one predetermined characteristic of the MEMS acoustic sensor and at least one characteristic of the MEMS acoustic sensor that is determined in response to the test acoustic signal.

7. The device of claim 1, wherein the test acoustic signal is an ultrasonic signal.

8. The device of claim 1, wherein the processor is configured to detect the blockage condition based on at least one other characteristic of the output in response to the test acoustic signal.

9. The device of claim 1, wherein the processor is configured to detect the blockage condition based on a change in sensitivity of the MEMS acoustic sensor in response to the test acoustic signal being received via the opening of the cavity that contains the MEMS acoustic sensor, and wherein the sensitivity is indicative of a ratio of the output associated with the MEMS acoustic sensor to an input pressure.

10. The device of claim 1, wherein the processor is configured to detect the blockage condition based on a shift of the resonant peak of the output associated with the MEMS acoustic sensor in response to the test acoustic signal being received via the opening of the cavity that contains the MEMS acoustic sensor.

11. The device of claim 1, wherein the processor is configured to detect the blockage condition based on a proximity sensor associated with the MEMS acoustic sensor.

12. The device of claim 1, wherein the processor is configured to detect the blockage condition based on a voltage value with respect to a Pascal value associated with the MEMS acoustic sensor.

13. A method comprising:

receiving a test acoustic signal associated with a test waveform via an opening of a cavity that encloses a microelectromechanical systems (MEMS) acoustic sensor; and detecting, in response to the test acoustic signal received via the opening of the cavity that encloses the MEMS acoustic sensor, a blockage condition associated with the MEMS acoustic sensor based on analysis of a resonant peak of an output signal generated by the MEMS acoustic sensor in response to the test acoustic signal received via the opening of the cavity that encloses the MEMS acoustic sensor; and modifying functionality of the MEMS acoustic sensor in response to a determination that the resonant peak satisfies a defined criterion.

14. The method of claim 13, wherein the detecting the blockage condition associated with the MEMS acoustic sensor comprises detecting the blockage condition associated with the MEMS acoustic sensor based on a change in sensitivity of the MEMS acoustic sensor in response to the test acoustic signal.

15. The method of claim 13, wherein the detecting the blockage condition associated with the MEMS acoustic sensor comprises detecting the blockage condition associated with the MEMS acoustic sensor based on a shift of the resonant peak of the output signal generated by the MEMS acoustic sensor in response to the test acoustic signal received via the opening of the cavity that encloses the MEMS acoustic sensor.

16. The method of claim 13, wherein the detecting the blockage condition associated with the MEMS acoustic sensor comprises detecting the blockage condition associated with the MEMS acoustic sensor based on at least one proximity sensor associated with the opening.

17. The method of claim 13, further comprising:

generating the test acoustic signal via an acoustic signal generator.

18. The method of claim 17, wherein the generating the test acoustic signal comprises generating an ultrasonic signal via the acoustic signal generator.

19. The method of claim 17, wherein the receiving the test acoustic signal comprises receiving an ultrasonic signal via the opening of the cavity that encloses the MEMS acoustic sensor.

20. A system, comprising:

a first microelectromechanical systems (MEMS) microphone contained in a first cavity within a device and configured to receive a test acoustic signal associated with a test waveform;

a second MEMS microphone contained in a second cavity within the device; and at least one processor configured to detect a blockage condition associated with a least the first MEMS microphone based on analysis of a resonant peak of an output signal associated with the first MEMS microphone in response to the test acoustic signal being received via an opening of the first cavity that contains the first MEMS microphone, and to modify functionality of the first MEMS acoustic sensor in response to a determination that the resonant peak satisfies a defined criterion.

21. The system of claim 20, wherein the at least one processor is configured to detect the blockage condition based on a change in a frequency response pattern of the first MEMS microphone in response to the test acoustic signal being received via the opening of the first cavity that contains the first MEMS microphone.

22. The system of claim 20, wherein the at least one processor is configured to detect the blockage condition based on a proximity sensor associated with the first MEMS microphone.

23. The system of claim 20, wherein the second MEMS microphone is configured to generate the test acoustic signal.

* * * * *